US005245723A

United States Patent [19]

Sommer

[11] Patent Number: 5,245,723

[45] Date of Patent: Sep. 21, 1993

[54] SELF-PROPELLED CLEANING APPARATUS, PARTICULARLY FOR SWIMMING POOLS

[75] Inventor: Peter Sommer, Villnachern, Switzerland

[73] Assignee: 3S Systemtechnik AG, Remigen, Switzerland

[21] Appl. No.: 747,891

[22] Filed: Aug. 19, 1991

[30] Foreign Application Priority Data

Oct. 31, 1990 [CH] Switzerland ..... 3469/90

[51] Int. Cl.[5] ..... E04H 3/20

[52] U.S. Cl. ..... 15/1.7; 15/52.1; 15/347; 15/383

[58] Field of Search ..... 15/1.7, 347, 383; 210/169

[56] References Cited

U.S. PATENT DOCUMENTS 4,154,680 5/1979 Sommer ..... 15/1.7
4,168,557 9/1979 Rasch ..... 15/1.7
4,304,022 12/1981 Sommer ..... 15/1.7
4,518,437 5/1985 Sommer ..... 15/1.7

FOREIGN PATENT DOCUMENTS

9648/27 9/1928 Australia ..... 15/1.7
0314259 5/1989 European Pat. Off. ..... 15/1.7
2175350 10/1973 France .
464358 11/1936 United Kingdom .
1565607 4/1980 United Kingdom .

*Primary Examiner*—Edward L. Roberts
*Attorney, Agent, or Firm*—Egli International

[57] ABSTRACT

In a self-propelled cleaning apparatus, particularly for swimming pools, a cleaning apparatus drive (9) is integrated into a basic casing (1) and at least one cleaning brush (21) and a suction duct (29) are provided. By means of the said suction duct (29) the liquid to be cleaned is delivered by means of a pump (40) into a filter chamber (35). The filter chamber (35) extends over almost the entire top of the basic casing (1) and is covered by a casing cover (41).

8 Claims, 4 Drawing Sheets

SELF-PROPELLED CLEANING APPARATUS, PARTICULARLY FOR SWIMMING POOLS

BACKGROUND OF THE INVENTION

The invention relates to a self-propelled cleaning apparatus, particularly for swimming pools, with a basic casing, in which is integrated a drive for the cleaning apparatus and at least one cleaning brush, together with a suction duct, means of which the liquid to be cleaned can be delivered by means of a pump into a filter chamber.

For cleaning water basins and in particular swimming pools, it is known to make use of cleaning apparatuses enabling the bottom and optionally the walls of the pool to be cleaned. Such apparatuses are operated from outside the pool. For example EP-A-0 099 489 discloses a cleaning apparatus in which on either side of a basic casing are provided rotary cleaning brushes, and the liquid to be cleaned is sucked in and conveyed into a filter located on the basic casing. On striking against a pool wall the drive is reversed by means of corresponding sensors and optionally the travel direction of the cleaning apparatus is changed. Although this cleaning apparatus operates in a completely satisfactory manner, due to its high filter construction it has considerable flow resistance.

SUMMARY OF THE INVENTION

The problem of the invention is to develop a cleaning apparatus of the aforementioned type, which has a compact construction and which is improved from the flow standpoint and in which an improved suction and filtering of the liquid to be cleaned are ensured.

According to the invention this problem is solved in that the filter chamber extends virtually over the entire top of the basic casing and is covered by a casing cover.

In said cleaning apparatus there is no high filter construction, so that the flow resistance is reduced and consequently energy is saved on operating the cleaning apparatus. The esthetic design is also improved.

The casing cover is connected by means of a hinge to the basic casing.

On raising said casing cover, the filter chamber and in particular a filter mat located therein becomes freely accessible so that filter mat can easily be cleaned or replaced.

Preferably, the filter mat in the filter chamber covers V-grooves shaped into the basic casing. These V-grooves can be at right angles or parallel to the casing longitudinal axis and allow a large-area drainage of the filtered water.

Into the filter chamber projects a connecting piece, which is connected to a central chamber, which contains the pump. The pump is preferably a vortex pump, which is coupled to the casing drive, i.e. to the motor or a gear part. The pump must be able to deliver in both rotation directions, i.e. both during forward and reverse travel.

From the central chamber, ducts lead to corresponding intakes which are associated with the cleaning brush. Preferably, these ducts are at an angle to the casing longitudinal axis, so that there is a high transverse flow from both sides to the intakes.

According to a preferred embodiment of the invention, the cleaning brush is connected by means of a lever joint to the basic casing. The lever joint can be positioned centrally and have a cardan-type construction.

The lever joint is also constructed in such a way that the cleaning brush can compensate for unevennesses of the pool bottom. This is helped by the fact that the cleaning brush preferably comprises two brush rollers arranged laterally of the lever joint and which are separately movable, so that account is also taken of smaller uneven areas.

The cleaning brush is preferably connected to the drive of the cleaning apparatus and e.g. to corresponding driven wheels. This can take place by means of toothed belts.

Preferably, to the rear in the direction of travel, an additional transverse brush together with the cleaning brush enclose a suction chamber, which also improves the corresponding suction flow.

Further advantages, features and details of the invention can be gathered from the following description of preferred embodiments relative to the drawings.

DETAILED DESCRIPTION OF THE PREFERRED EMBODIMENTS

Figure 1:
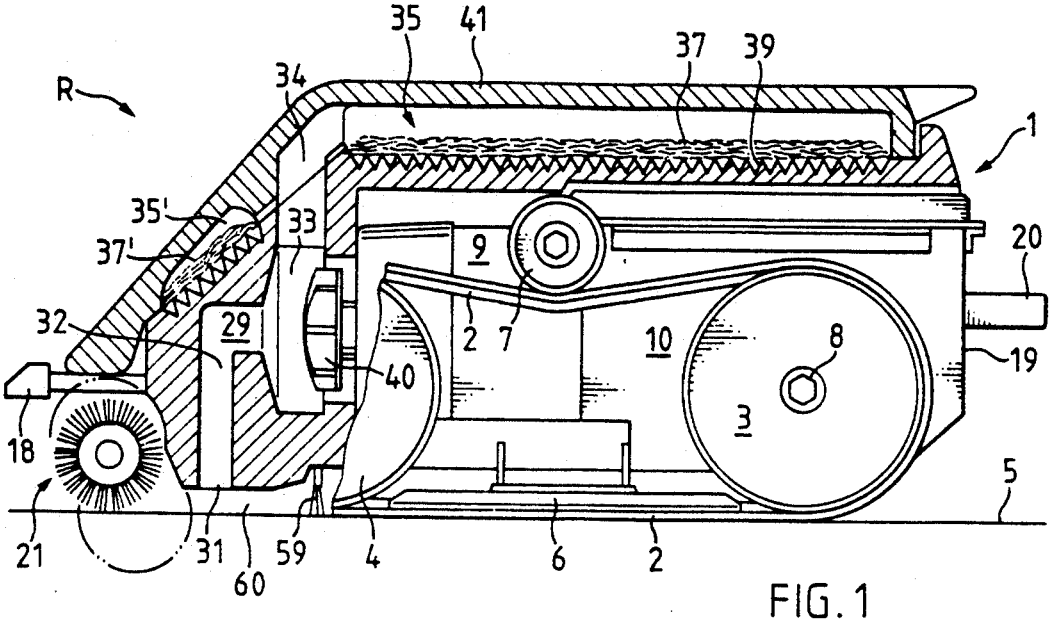
FIG. 1 a diagrammatically represented longitudinal section through an inventive swimming pool cleaning apparatus.

The inventive cleaning apparatus R for swimming pools has a basic casing 1, which can be propelled. Movement takes place on corresponding, optionally profiled movement belts 2 arranged on either side of the basic casing 1 and which have a continuous construction and are placed over two spaced wheels 3,4 or guide pulleys. Between the two wheels 3 and 4 is provided a belt guide 6 towards the substrate 5. On the other side of the belt guide 6, a tensioning pulley 7 presses on the movement belt 2. The movement belts 2 arranged on either side preferably have a caterpillar-type construction.

Figure 3:
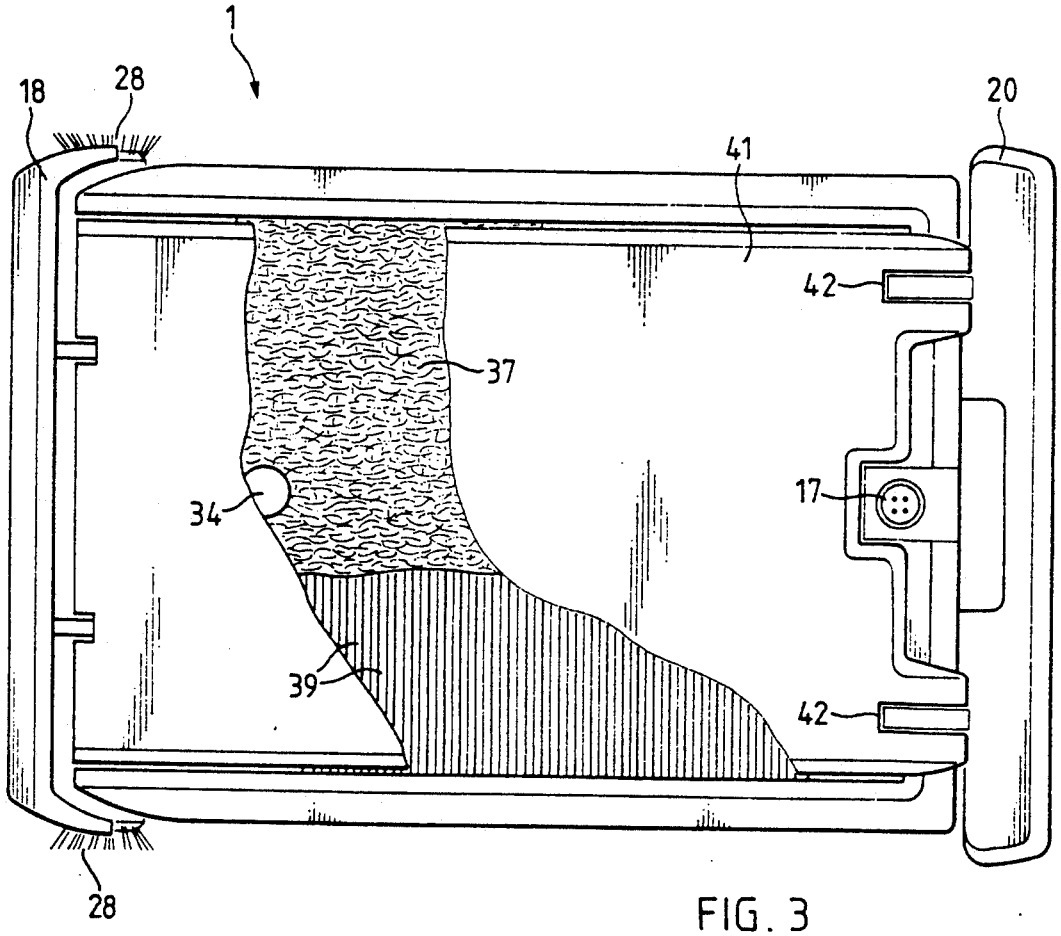
FIG. 3 is a partly opened plan view of the cleaning apparatus of FIG. 1.

In the present embodiment, preferably one axle 8 of the rear wheels 3 is driven. A motor is provided for said drive 9, which is only diagrammatically shown in FIG. 1. The motor can be connected by means of a gear 10 to the axle 8. A power part and a control logic are also provided for the motor. A floating cable is separably connected by means of a not shown plug to a socket 17 shown in FIG. 3.

A contact member 18 is placed at the front on the basic casing 1 and e.g. informs the control logic when contact is made with the swimming pool wall. On the rear wall 19 of the casing 1 is also provided a reversing bar 20, which can also bring about a reversing of the drive 9 to forward on reverse travel. However, reference is only made thereto in an exemplified manner, because this does not constitute part of the invention.

Figure 2:
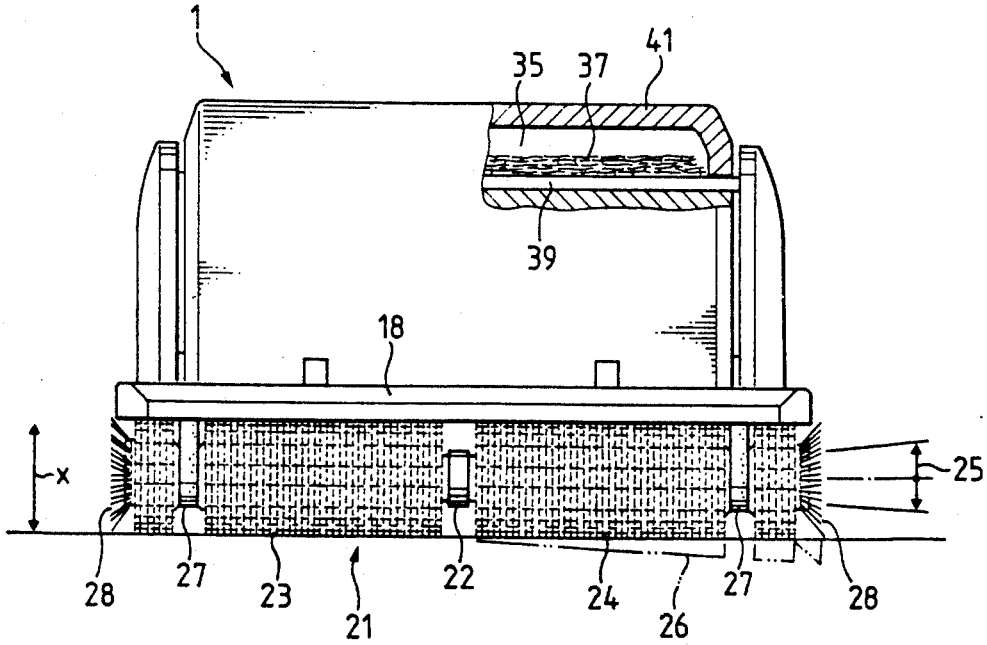
FIG. 2 is a partly broken away front view of the swimming pool cleaning apparatus of FIG. 1.

In addition, a cleaning brush 21 is located on the front of the basic casing 1. As shown in FIG. 2, said cleaning brush 21 is connected by a roughly centrally arranged lever joint 22 to the casing 1. There is a cardan suspension of the brush rollers 23,24 to the left and right of the lever joint 22, so as to permit not only a vertical movement of the cleaning brush 21 in direction x, but also an oscillation of each brush roller 23 or 24, as indicated by the double arrow 25 and the dot-dash line 26. As a result of this suspension the cleaning brush 21 or the brush roller 23 and 24 can adapt to unevenness in of the pool bottom.

Each brush roller 23 or 24 is also traversed by toothed belts 27, which rotate the cleaning brush 21. These toothed belts 27 are connected to the front wheels 4 of the drive for the movement belts 2. Further cleaning bristles 28 project laterally from the cleaning brush 21.

The two brush rollers 23, 24 are pivoted on a hollow shaft 43 having a longitudinal axis 44 and their brush bodies 45 are connected to a pinion 46. The end portion 47 of the brush body 45 is connected also to the pinion 46, which is a part of a belt drive consisting of the toothed belt 27, the pinion 46 and a pulley 48 connected laterally to the front wheel 4 of the drive 9 of the cleaning apparatus. The shaft 43 is supported at its center with a small play in a bore 49 of a narrow lever 50 and is fixed by a bolt 51. At each end of the shaft 43 a snap ring 52 holds the brush rollers 23, 24 in position. The bolt 51 allows slight tilting of the shaft 43 about the longitudinal axis 53 of the bolt 51 to compensate for smaller unevenness of the substrate 5. The axis 53 is parallel to the direction of travel of the cleaning apparatus and slightly sloped with respect to the horizontal plane. Lever 50 is fixedly connected to a crossbar 54, both ends of which are upwardly bent to arms 55 having a 90° angle with respect to the crossbar 54. The two arms 55 form together with the crossbar 54 an inverse yoke and are pivotable about an axis 56 which is also the axis of the front wheels 4 and of the pulley 48. This yoke allows a rotating motion of the lever 50 about the axis 56. Since the axis 56 is situated over the axis 44 of the shaft 43, the tension of the toothed belt 27 always pushes the brush rollers 23, 24 against the substrate 5. Additionally, the yoke leads to sufficient room in the center portion of the apparatus to place a vortex pump 40 and a central chamber 33 and allows the vertical motion of the cleaning brush 21.

Figure 4:
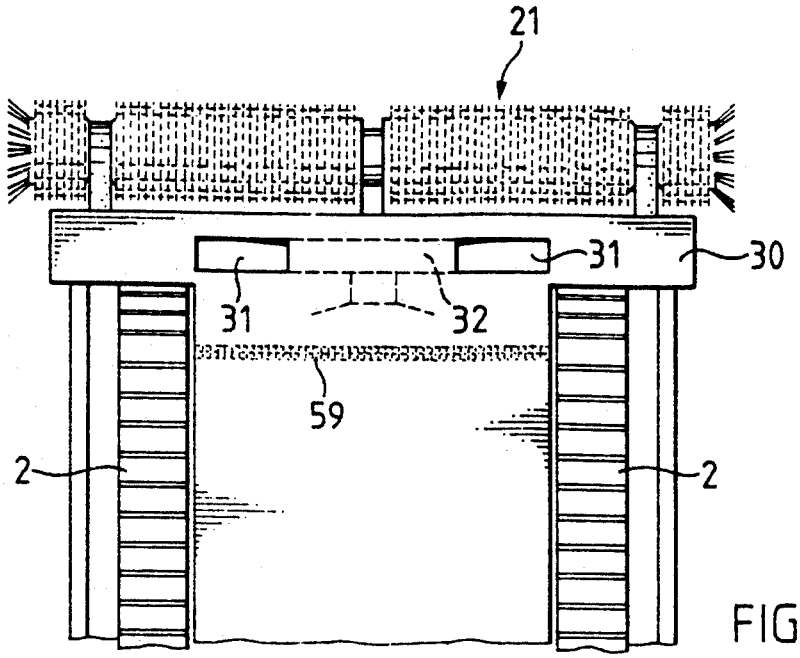
FIG. 4 is a partly represented view from below of the cleaning apparatus according to FIG. 1.
Figure 5:
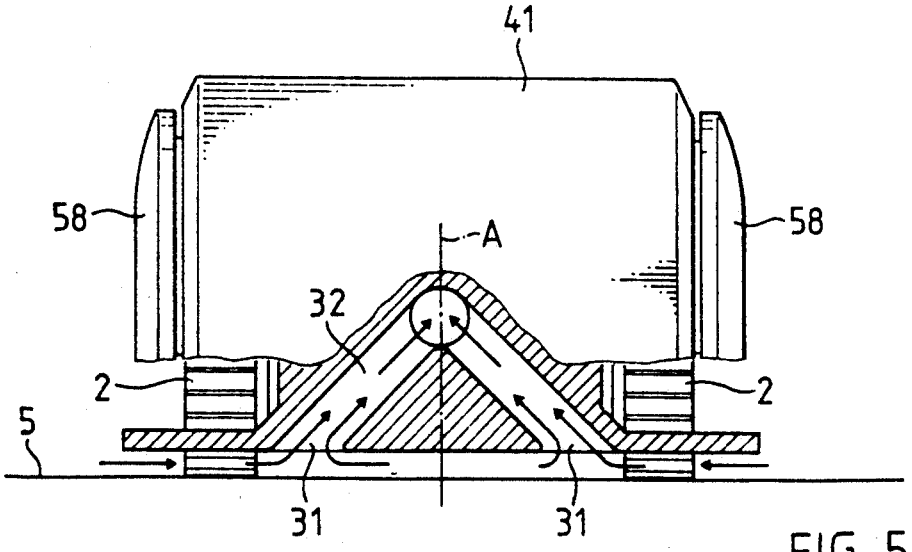
FIG. 5 is a partly represented cross-section through the cleaning apparatus of FIG. 1.
Figure 7:
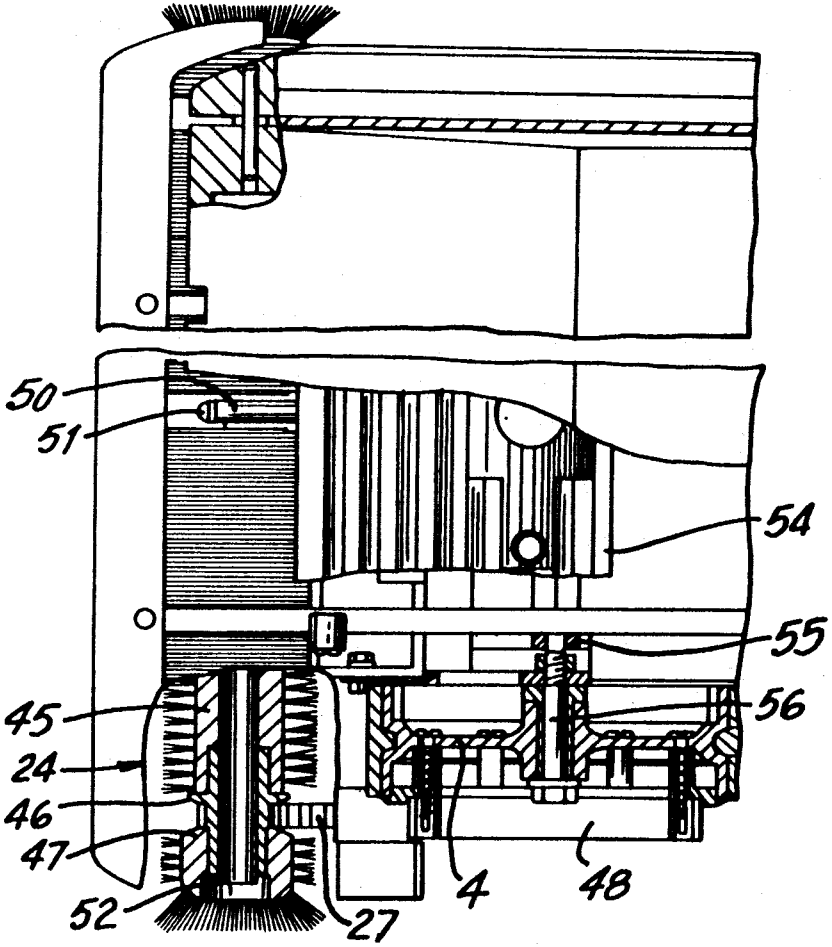
FIG. 7 is a partly open bottom view of the apparatus of FIG. 6.
Figure 6:
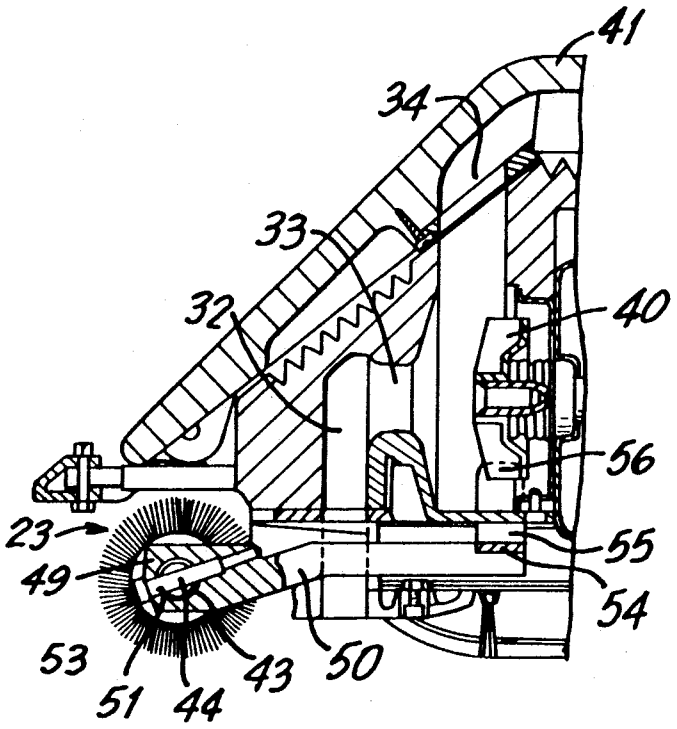
FIG. 6 is a more detailed view of a front portion of FIG. 1.

Behind the cleaning brush 21 in casing 1 is provided a suction duct 29, whose first part is shown in greater detail in FIGS. 4 and 5.

Close to the cleaning brush 21, the suction duct 29 issues via intakes 31 in a base plate 30 of the basic casing 1. In the present embodiment there are two such intakes 31, but this is only of an exemplified nature. From the intakes 31, sloping ducts 32 lead to the central chamber 33 (cf. FIG. 1). These ducts 32 are at an angle to the longitudinal axis A of the basic casing 1, so that the suction flow is significantly improved and is indicated by arrows.

From the central chamber 33, a connecting piece 34 leads into a filter chamber 35, which extends over virtually the entire basic casing. Reference numeral 35' indicates that this filter chamber 35 also continues at the front on either side of the connecting piece 34.

In the filter chamber 35 a filter mat 37 rests on the casing 1 and part 37' of said mat 37 is also located in the filter chamber part 35'. Towards the basic casing 1, the filter mat 37 is supported on V-grooves 39, in which the filtered liquid can be laterally removed from the filter chamber 35. The V-grooves 39 can obviously also run parallel to the longitudinal axis 8.

By means of a pump, which is preferably constructed as a vortex pump 40 and which is connected to the drive 9 or a corresponding gear part of the drive 9, the liquid to be filtered is sucked through the intakes 31 and the ducts 32 into the central chamber 33 and forced into the filter chamber 35. If, as is desired, the pump drive is coupled to the apparatus drive 9, the pump must be able to deliver in both rotation directions (forward or reverse travel). It must also be able to deliver to the downstream filter chamber 35 the dirt and contaminants which occur, without any prefiltering. This possibility is offered by the vortex pump 40 with concentrically arranged annular casing.

The filter chamber 35 is covered by a casing cover 41, which is connected by means of hinges 42 to the basic casing 1. Due to the fact that the filter chamber 35 is integrated into the actual cleaning apparatus R, the external dimensions of the latter can be kept extremely small, which has advantageous effects on the flow resistance of the cleaning apparatus and the esthetic design. It is important that the plastics material used has an adequate dimensional stability.

The filter mat 37 used is fixed between the flap-up casing cover 41 in a not shown fold. Optionally it is possible to provide a separate, fold-up filter cover for this purpose.

The liquid flows via the connecting piece 34 and its opening congruent with the filter mat 37 into the filter chamber 35. The filtered water passes out from the underside of the filter mat 37 and the V-grooves 39 ensure a large-area drainage of the filtered water. The drainage conditions are so defined that uniform outflow occurs over the entire filter mat 37.

The V-grooves 39 can e.g. also be formed by a corresponding support body, such as a perforated plate. As a variant an outflow is possible either directly or via calibrated bores on the bottom of the apparatus.

FIG. 5 also shows casing coverings 58 on either side and which in particular protect the drive 9 or the movement belts 2. In addition, in the direction of travel behind the intakes 31, there is a transverse brush 59, which together with the cleaning brush 21 forms a suction chamber 60. Together with the geometrical design of the ducts 32, in the suction chamber 60 there is a high transverse flow from either side towards the intakes 31. The resulting flow effect brings about an optimum suction action with respect to the impurities detached from the cleaning brush 21 and also sludge and sand deposited in gaps and joints.

I claim:

1. An apparatus for cleaning underwater substrates, comprising:

a housing; drive means for moving said housing; a motor mounted to said housing for reversible motion of said drive means; a pump coupled to said motor, said pump having a suction side with an intake and a suction duct, and a pressure side with a connecting piece connected so as to lead into a filter chamber; at least one cleaning brush arranged in front of the suction line inlet and driven by said motor, the filter chamber being arranged on top of said housing so as to distribute the water, said chamber extending over virtually the entire housing, said chamber having an outer wall formed by a cover and a bottom provided with a plurality of ribs with V-grooves therebetween; and a filter mat arranged on top of the ribs, said grooves and said filter mat forming outlet channels for filtered water, said pump delivering the water into said filter chamber so that the water flows from said chamber downward through the filter mat into the outlet channels to thereby press the filter mat into the tops of the ribs.

2. An apparatus according to claim 1, wherein the cover is connected to the housing by hinge means.

3. An apparatus according to claim 1, wherein the pump is a vortex pump located in a central chamber that is connected to the suction duct and to a connecting piece.

4. An apparatus according to claim 3, wherein said suction duct is comprised of at least two ducts between the central chamber and corresponding inlets, which ducts run at an angle to a longitudinal axis of the housing.

5. An apparatus according to claim 4, wherein the at least one cleaning brush is positioned at a right angle to the longitudinal axis, upstream of the inlets in a direction of travel of the apparatus.

6. An apparatus according to claim 5, wherein the at least one cleaning brush is supported on a lever that is connected to the housing in a vertically pivotable manner, and is comprised of two brush rollers that are arranged on opposite sides of the lever and are rotated by a toothed belt driven by the drive means.

7. An apparatus according to claim 6, wherein the drive means includes wheels, the toothed belts connecting the at least one cleaning brush to the wheels.

8. An apparatus according to claim 5, and further comprising a transverse brush arranged so as to follow the inlets in the direction of travel, and so as to form a suction chamber together with the at least one cleaning brush.

* * * * *